US005861566A

United States Patent [19]

Kaneko et al.

[11] Patent Number: 5,861,566

[45] Date of Patent: Jan. 19, 1999

[54] AUTOMATIC PLAYER PIANO HAVING FRAME STRUCTURE SELF-ALIGNED WITH KEYBOARD FOR EXACTLY POSITIONING KEY ACTUATORS ARRANGED IN STAGGERED MANNER

[75] Inventors: Yasutoshi Kaneko; Kiyoshi Kawamura, both of Hamamatsu, Japan

[73] Assignee: Yamaha Corporation, Shizuoka-ken, Japan

[21] Appl. No.: 777,479

[22] Filed: Dec. 30, 1996

[30] Foreign Application Priority Data

Dec. 28, 1995 [JP] Japan ..... 7-343687

[51] Int. Cl.[6] ..... G10F 1/02

[52] U.S. Cl. ..... 84/13

[58] Field of Search ..... 84/7, 13, 18, 20, 84/25, 27, 29, 30

[56] References Cited

U.S. PATENT DOCUMENTS 4,031,796 6/1977 Wilkes ..... 84/20
4,741,237 5/1988 Murakami et al. ..... 84/20
4,873,905 10/1989 Murakami et al. ..... 84/20
5,194,685 3/1993 Kawamura et al. ..... 84/670
5,527,987 6/1996 Yamamoto et al. ..... 84/18

FOREIGN PATENT DOCUMENTS 62-37269 9/1987 Japan .

*Primary Examiner*—William M. Shoop, Jr.
*Assistant Examiner*—Jeffrey W. Donels
*Attorney, Agent, or Firm*—Hazel & Thomas, PC

[57] ABSTRACT

An automatic player piano has solenoid-operated key actuator units under a keyboard mounted on a wooden key bed, and the solenoid-operated key actuator units are supported by a frame structure inserted into a slot formed in the wooden key bed and bolted to metallic bracket members screwed to the wooden key bed; when the frame structure is taken out for a repairing work, the bracket members are never removed from the wooden key bed, and the bolt holes of the wooden key bed are never undesirably enlarged.

6 Claims, 12 Drawing Sheets

AUTOMATIC PLAYER PIANO HAVING FRAME STRUCTURE SELF-ALIGNED WITH KEYBOARD FOR EXACTLY POSITIONING KEY ACTUATORS ARRANGED IN STAGGERED MANNER

FIELD OF THE INVENTION

This invention relates to an automatic player piano and, more particularly, to an automatic player piano having a frame structure self-aligned with a keyboard for exactly positioning solenoid-operated key actuator units arranged in a staggered manner.

DESCRIPTION OF THE RELATED ART

The automatic player piano is equipped with a plurality of solenoid-operated key actuator units under the keyboard, and the solenoid-operated key actuator units selectively project the plungers so as to move the black and white keys without a fingering of a pianist.

At typical example of the automatic player piano is disclosed in Japanese Utility model Publication of Examined Application No. 6-37269. The Japanese Utility Model Publication of Examined Application discloses two kinds of arrangement of solenoid-operated key actuator units. These two kinds of arrangement are firstly described hereinbelow. In the following description, term "lateral direction" means a direction parallel to the center line around which the black and white keys turn, term "fore-and-aft direction" means a direction perpendicular to the lateral direction on a virtual plane parallel to the key bed, and term "vertical direction" is a direction normal to the virtual plane or a direction parallel to the gravity. Direction of "clockwise" and direction of "counter clockwise" are determined on the figure which description refers to.

One of the two kinds of arrangement is featured by a staggered arrangement of solenoid-operated key actuator units. A bracket member is provided under the key bed, and the solenoid-operated key actuator units are attached to the bracket. The solenoid-operated key actuator units respectively have the projectable plungers aligned with the black and white keys, and are arranged in the lateral direction. The solenoid-operated key actuator units are staggered so as to space every other solenoid-operated key actuator unit from the adjacent solenoid-operated key actuator units in the vertical direction, and the staggered arrangement allows the solenoid-operated key actuator units to occupy wide spaces, respectively. In other words, the solenoid-operated key actuator units are allowed to have large solenoids, and the large solenoid imparts large force to the plunger.

The other kind of arrangement is featured by an elongated yoke shared between the solenoid-operated key actuator units. The yoke is elongated in the lateral direction, and accommodates the solenoids. Although the elongated yoke makes the solenoids stand in line, the solenoid-operated key actuator units have large solenoids, and impart strong forces to the associated black and white keys.

Thus, the prior art arrangements of solenoid-operated key actuator units allows the manufacturer to enlarge the solenoids, and the large solenoids cause the plungers to strongly push the associated black and white keys. However, the first prior art arrangement of solenoid-operated key actuator units encounter a problem in poor durability. As described hereinbefore, every other solenoid-operated key actuator unit is spaced from the adjacent solenoid-operated key actuator units in the vertical direction. Although the solenoid-operated key actuator units in the upper line are close to the black and white keys, the other solenoid-operated key actuator units in the lower line are fairly spaced from the associated keys, and the long distance requires long plungers to push the associated keys. When the plunger pushes the associated key, the reaction takes place at the leading end of the plunger, and causes the long plunger to be bent. Therefore, the solenoid-operated key actuator units in the lower line are not durable.

Another problem in the first prior art arrangement of solenoid-operated key actuator units is the over-crowded spacious arrangement under the key bed. The space under the key bed is occupied by various parts and mechanisms such as links of the pedal mechanisms, and the bracket interferes with these parts and mechanisms. For this reason, it is hard to retrofit an acoustic piano to the automatic player piano by using the first prior art arrangement of solenoid-operated key actuator units.

The second prior art solenoid operated key actuator units encounter a problem in insufficient force transferred to the associated key. Although the elongated yoke allows the manufacturer to enlarge the solenoids, the pitch of keys sets a limit to the enlargement. The pitch of keys incorporated in a standard acoustic piano ranges from 13 millimeters to 15 millimeters, and, accordingly, the plungers are also arranged at the same pitch. This means that the solenoids are never enlarged over the pitch, and limit the electromagnetic force.

One solution is proposed in Japanese Utility Model Publication of Unexamined Application No. 58-38195. The prior art automatic player piano disclosed in the Japanese Utility Model Publication is illustrated in FIG. 1 of the drawings. The prior art automatic player piano largely comprises an acoustic piano 1 and an automatic playing system 2. The acoustic piano 1 includes a keyboard mounted on a key bed 1*b*. A balance rail 1*c* is provided on the key bed 1*b*, and a plurality of black and white keys 1*d* are turnably supported by the balance rail 1*c*. Although the black and white keys 1*d* are connected to key action mechanisms for striking strings with hammers, the structure of the acoustic piano is well known to a person skilled in the art, and they are not shown in FIG. 1.

The automatic playing system 2 includes a plurality of solenoid-operated key actuator units 2*a*, a driving circuit 2*b* fabricated on a print board 2*c* and a frame structure 2*d* for supporting the solenoid-operated key actuator units 2*a* and the print board 2*c*. A pan 2*e* and a cover plate 2*f* form an inner space, and are bolted through a bracket member to the key bend 1b and the balance rail 1*c*, respectively. The print board 2*c* is inserted between the bracket member 2*g* and the pan 2*e*, and is fixed thereto.

A plurality of pairs of through holes 2*h* are formed in the pan 2*e* and the cover plate 2*f*, and are arranged in a staggered manner. The pairs of through holes 2*h* are respectively assigned to the solenoid-operated key actuator units 2*a*, and, accordingly, the solenoid-operated actuator units 2*a* are arranged in the staggered manner. The solenoid-operated key actuator units 2*a* make two rows spaced apart from one another in the fore-and-aft direction.

Each of the solenoid-operated key actuator units 2*a* includes a bobbin 2*i* accommodated in the inner space, a coil 2*j* wound on the bobbin 2*i*, yokes 2*k* inserted into the pair of through-holes 2*h*, a plunger 2*m* slidably inserted into the yokes 2*k* and a cushion member 2*n* attached to the leading end of the plunger 2*n*. When the driving circuit 2*b* applies electric current to the coil 2*j*, the yokes 2*k* is magnetized, and cause the plunger 2*m* to upwardly project therefrom. As a result, the cushion member 2*n* pushes up the key 1*d*, and the key 1*d* is moved as if a player depresses it.

The solenoid-operated key actuator units 2*a* are arranged in the staggered manner on the key bed 1*b*, and the plungers 2*m* are relatively shorter than those of the solenoid-operated key actuator units incorporated in the Japanese Utility Model Publication of Examined Application No. 62-37269. For this reason, the plungers 2*m* are hardly bent, and are, accordingly, durable. However, the automatic playing system 2 encounters a problem in repairing work. The frame structure 2*d* is provided between the key bed 1*b* and the keyboard 1*a*, and the solenoid-operated key actuator units 2*j* are accommodated in the inner space between the pan 2*e* and the cover plate 2*f*. If one of the solenoid-operated key actuator units 2*a* is broken down, a repairing worker firstly removes the keyboard 1*a*, and loosens the bolts so as to move the frame structure to a floor. Then, the repairing worker removes the cover plate 2*f* from the pan 2*e*, and changes the broken solenoid-operated key actuator unit 2*a* to new one. The repairing work is usually required after a delivery to a user, and the repairing worker feels the work difficult.

Another solution is disclosed in Japanese Utility Model Publication of Unexamined Application No. 2-95394, and the prior art automatic player piano is illustrated in FIG. 2 of the drawings. The prior art automatic player piano also comprises an acoustic piano 3 and an automatic playing system 4. The acoustic piano 3 is a grand piano, and a keyboard 3*a* is placed on a key bed 3*b* formed of wood. Black and white keys 3*c* and 3*d* are turnably supported by a balance rail 3*e*. Key action mechanisms 3*f* are connected to the black and white keys 3*c*/3*d*, and drive hammers 3*g*, respectively, so as to strike strings (not shown).

The automatic playing system 4 comprises a plurality of solenoid-operated key actuator units 4*a* respectively associated with the black and white keys 3*c*/3*d*, a frame structure 4*b* for the solenoid-operated key actuator units 4*a* and a controller (not shown) for selectively driving the solenoid-operated key actuator units 4*a*. A slot 3*h* is formed in the key bed 3*b*, and is laterally elongated under the rear end portions of the black and white keys 3*c*/3*d*. The solenoid-operated key actuator units 4*a* are supported by the frame structure 4*b*, and the frame structure 4*b* is partially inserted into the slot 3*h* so as to position the solenoid-operated key actuator units 4*a* under the rear end portions of the black and white keys 3*c*/3*d*, respectively.

The solenoid-operated key actuator units 4*a* make two rows, and are arranged in a staggered manner in the slot 3*h*. The two rows are spaced from each other in the fore-and-aft direction, and are leveled. For this reason, all of the plungers are short, and are durable.

The frame structure 4*b* has an inner shell 4*c* and outer shell 4*d*. The outer shell 4*d* is fixed to the key bed 3*b* by means of bolts 4*e*, and the solenoid-operated key actuator units 4*a* are attached to the inner shell 4*c*. The inner shell 4*c* is inserted into the outer shell 4*d*, and is supported by regulating bolts 4*f* and 4*g* screwed through the outer shell 4*d*. The solenoid-operated key actuator units 4*a* are aligned with the rear end portions of the black and white keys 3*c*/3*d* by using the regulating bolts 4*f* and 4*g*. The solenoid-operated key actuator units 4*a* are supported by the inner shell 4*c*, and the inner shell 4*c* is supported through the regulating bolts 4*f*/4*g* by the outer shell 4*d* which in tern is supported through the bolts 4*e* by the key bed 3*b*.

When the solenoid-operated key actuator unit is troubled, a repairing worker loosens the bolts 4*e*, and removes the frame structure 4*b* from the acoustic piano 3. The regulating bolts 4*f*/4*g* are loosened, and the inner shell 4*c* is separated from the outer shell 4*d*. Then, the repairing worker has access to the solenoid-operated key actuator units 4*a*, and replaces the broken solenoid-operated key actuator unit with a new one.

Thus, the automatic playing system 4 disclosed in Japanese Utility Model Publication of Unexamined Application No. 2-95394 is easily replaceable, because the frame structure 4*b* is downwardly taken away from the key bed 3*b*. However, trouble is encountered in the prior art automatic player piano in that the frame structure 4*b* is liable to fall down after the repairing work. The outer shell 4*d* is directly bolted to the key bed 3*b*, and the holes of the wooden key bed 3*b* tend to be enlarged during the loosening work. For this reason, the bolts 4*e* can not fixedly engage with the key bed 3*b*, and the frame structure 4*b* is liable to fall down due to insufficient fixing force. Moreover, when the holes are enlarged, the repairing worker is required to form new holes in both of the wooded key bed 3*b* and the outer shell 4*d*. However, the repairing work is usually carried out at user's home, and a special jig is not used for the repairing work. For this reason, the solenoid-operated key actuator units 4*a* are not exactly aligned with the keys 3*c*/3*d*.

SUMMARY OF THE INVENTION

It is therefore an important object of the present invention to provide an automatic player piano which is easy to repair without damage to a key bed.

To accomplish the object, the present invention proposes to insert a metallic bracket member between a wooden key bed and a supporting structure for solenoid-operated key actuator units.

In accordance with the present invention, there is provided an automatic player piano comprising: an acoustic piano including a keyboard having a plurality of turnable keys for generating acoustic piano sounds and provided over an upper surface of a wooden key bed formed with a slot under the plurality of turnable keys; and an automatic playing system including a bracket member formed of metal and fixed to a lower surface of the wooden key bed, a supporting structure bolted to the bracket member and partially inserted into the slot, and a plurality of solenoid-operated key actuator units supported by the supporting structure in a staggered manner on a virtual plane substantially in parallel to the lower surface of the wooden key bed and having respective plungers respectively aligned with the plurality of keys so as to push the plurality of keys when the plurality of solenoid-operated key actuator units are energized.

BRIEF DESCRIPTION OF THE DRAWINGS

The features and advantages of the automatic player piano according to the present invention will be more clearly understood from the following description taken in conjunction with the accompanying drawings in which.

DESCRIPTION OF THE PREFERRED EMBODIMENT

Figure 1:
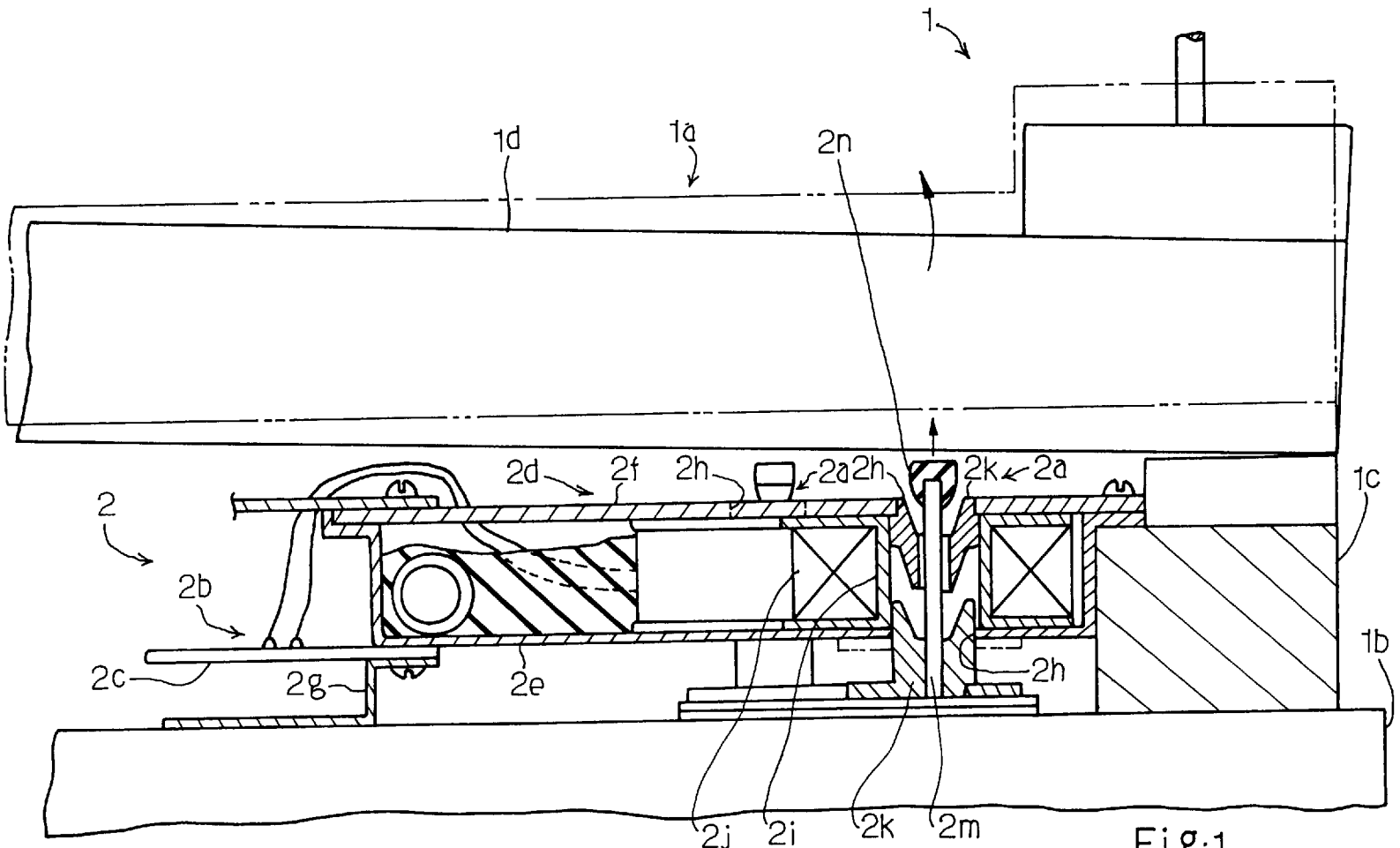
Fig.1 PRIOR ART
FIG. 1 is a cross sectional side view showing the prior art automatic player piano disclosed in Japanese Utility Model Publication of Unexamined Application No. 58-38195.
Figure 2:
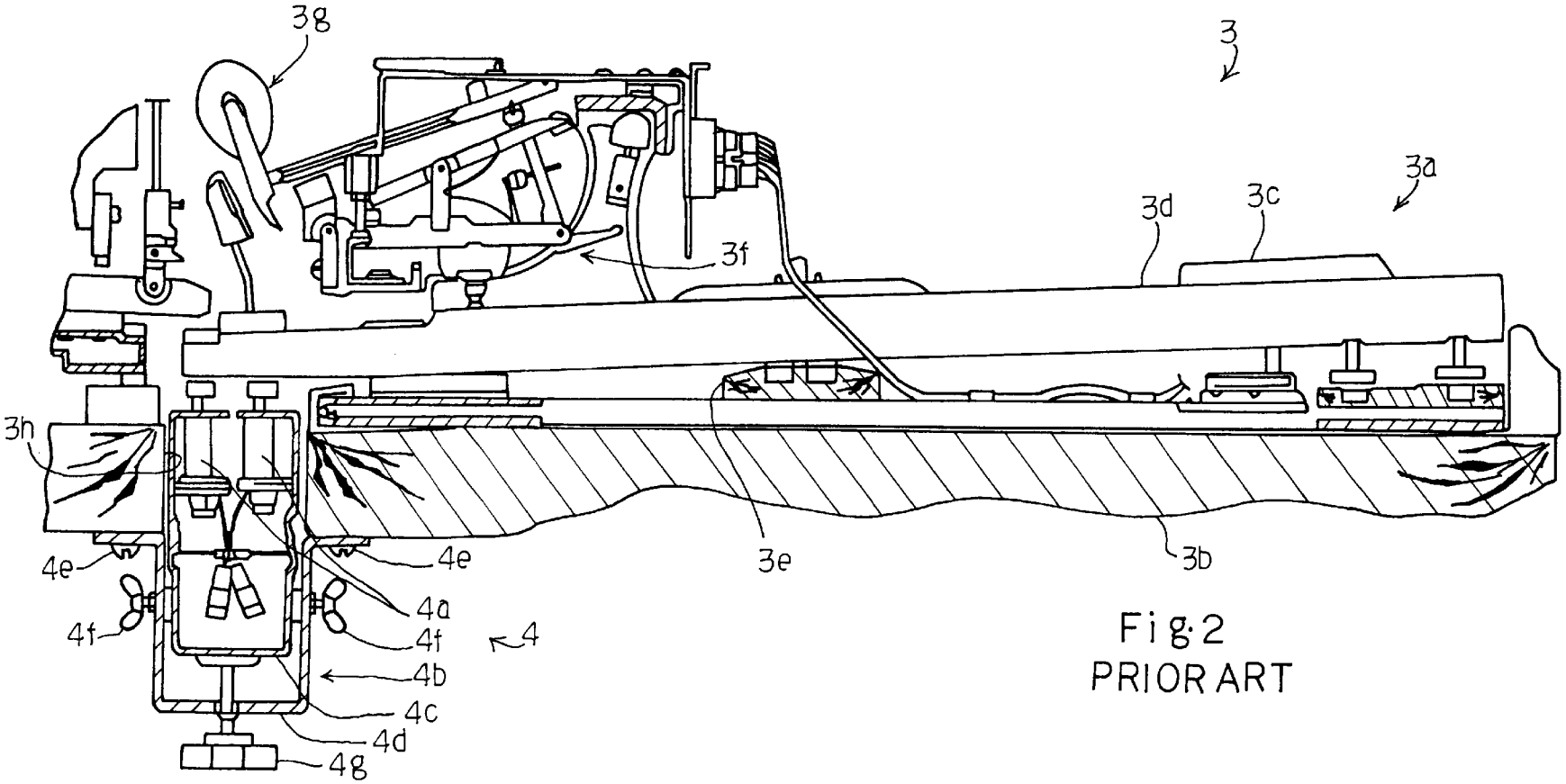
Fig. 2 PRIOR ART
FIG. 2 is a cross sectional side view showing the prior art automatic player piano disclosed in Japanese Utility Model Publication of Unexamined Application No. 2-95394.
Figure 3:
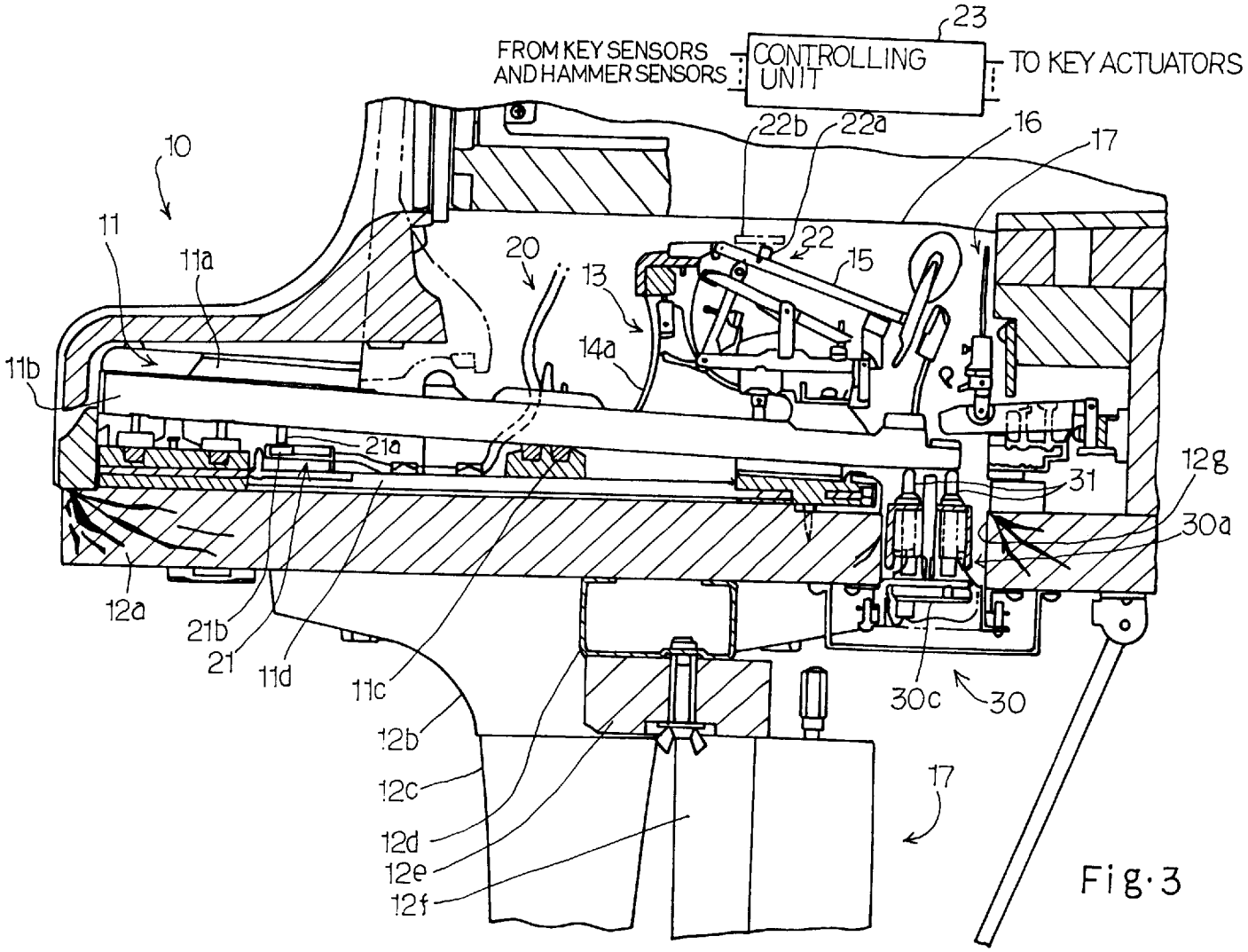
FIG. 3 is a cross sectional side view showing an automatic player piano according to the present invention.

Referring first to FIG. 3 of the drawings, an automatic player piano embodying the present invention largely comprises an acoustic piano 10, a recording system 20 and an automatic playing system 30. Description is hereinbelow made on the acoustic piano 10, the recording system 20 and the automatic playing system 30.

Structure of Acoustic Piano

The acoustic piano 10 includes a key board 11 placed on a key bed 12*a*, a plurality of key action mechanisms 13 supported by action brackets 14*a* on the key bed 12*a*, a plurality of hammer assemblies 15 turnably supported by the action brackets 14*a*, a plurality of sets of strings 16 stretched over the hammer assemblies 15 and a plurality of damper mechanisms 17 for absorbing vibrations of the strings 16.

A plurality of black keys 11*a* and a plurality of white keys 11*b* form the keyboard 11, and are turnable with respect to a balance rail 11*c* on a key frame 11*d*. The key bed 12*a* is attached to a leg block 12*b*, and the leg block 12*b* is supported by leg 12*c*. Though not shown in FIG. 3, the key bed 12*a* is further supported by other legs.

The acoustic piano 10 further comprises three pedal mechanisms 18*a*, 18*b* and 18*c* (see FIG. 4) respectively linked with a soft pedal, a damper pedal and a sostenuto pedal (not shown). When a player steps on the soft pedal, the soft pedal actuates the pedal mechanism for lessening the volume. The damper pedal causes the associated pedal link mechanism to hold off the damper heads (not shown) for prolonging the sounds, and the sostenuto pedal enables selected notes to be sustained independently.

A hottom boam 12*d* is attached to the lower surface of the key bed 12*a*, and a lyre block 12*e* is bolted to the hottom boam 12*d*. The lyre block 12*e* supports a lyre post 12*f*, and the soft pedal, the damper pedal and the sostenuto pedal are turnably supported by a lyre box (not shown) supported by the lyre post 12*f*. The pedal mechanisms are similar to those of a standard grand piano, and no further description is incorporated hereinbelow for the sake of simplicity.

Figure 5:
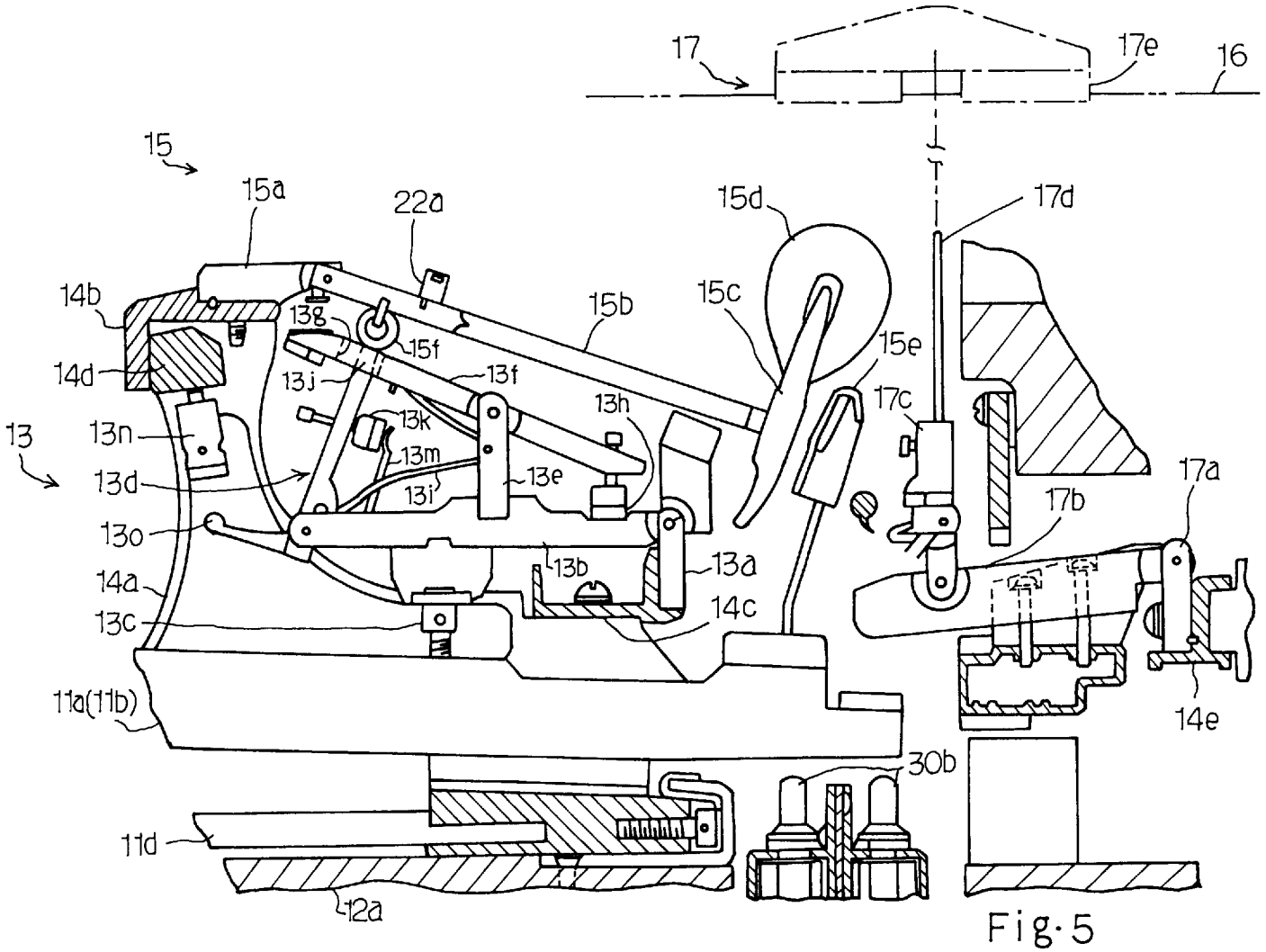
FIG. 5 is a side view showing a key action mechanism, a hammer assembly and a damper mechanism incorporated in the automatic player piano.

FIG. 5 illustrates the key action mechanism 13, the hammer assembly 15 and the damper mechanism 17 when the associated key 11*a*/11*b* is in a rest position, i.e., state where no force is exerted on the associated key 11*a*/11*b*. A hammer shank rail 14*b* and a whippen rail 14*c* laterally extend, and are fixed to the action brackets 14. A whippen flange 13*a* is attached to the whippen rail 14*c*, and a whippen assembly 13*b* is turnably connected at one end thereof to the whippen flange 13*a*. A capstan screw 13*c* projects from the associated key 11*a*/11*b*, and is in contact with the whippen assembly 13*b*.

A jack 13*d* is shaped into an L-shaped configuration, and is turnably connected at the other end thereof to the whippen assembly 13*b*. A repetition lever flange 13*e* stands on the whippen assembly 13*b* at a central portion, and a repetition lever 13*f* is turnably supported by the repetition lever flange 13*e*. A through hole 13*g* is formed in one end portion of the repetition lever 13*f*, and the leading end portion 13*j* of the jack 13*d* is inserted into the through hole 13*g*. A repetition stop button 13*h* is fixed to the other end portion of the repetition lever 13*f*, and a repetition spring 13*i* is inserted between the whippen assembly 13*b* and the repetition lever 13*f*. The repetition spring 13*i* urges the repetition lever in the clockwise direction, and the repetition stop button 13*h* is pressed against the upper surface of the whippen assembly 13*b*. A jack button 13*k* projects from the jack 13*d*, and the repetition spring 13*i* urges the jack 13*d* so as to press the jack button against a jack stop spoon 13*m* implanted into the whippen assembly 13*b*.

A regulating rail 14*d* is fixed to the shank flange rail 14*b*, and a regulating button 13*n* is connected to the regulating rail 14*d*. The regulating button 13*n* is opposed to the toe 13*o* of the jack 13*d*, and the toe 13*o* is brought into contact with the regulating button 13*n* during the movement of the associated key 11*a*/11*b*.

A hammer shank flange 15*a* is fixed to the upper surface of the shank flange rail 14*b*, and a hammer shank 15*b* is turnably connected to the hammer shank flange 15*a*. A hammer wood 15*c* is fixed to the leading end portion of the hammer shank 15*b*, and holds a hammer top felt 15*d*. A back check 15*e* is supported by the rear end portion of the associated key 11*a*/11*b*, and the hammer wood 15*c* is brought into contact with the back check 15*e* after a rebound on the strings 16. A hammer roller 15*f* is rotatably supported by the hammer shank 15*b*, and is in contact with the upper surface of the repetition lever 13*f* around the through-hole 13*g*. A small gap takes place between the hammer roller 15*f* and the leading end portion 13*j* of the jack 13*d* inserted into the through-hole 13*g*.

A damper lever rail 14*e* laterally extends, and a damper lever flange 17*a* is fixed to the damper lever rail 14*e*. A damper lever 17*b* is turnably connected to the damper lever flange 17*a*, and a damper block 17*c* is turnably connected to the leading end portion of the damper lever 17*b*. The rear end portion of the associated key 11*a*/11*b* is brought into contact with the leading end portion of the damper lever 17*b* during the movement from the rest position to the end position. A damper wire 17*d* upwardly projects from the damper block 17*c*, and a damper head 17*e* is connected to the leading end of the damper wire 17*d*. The damper head 17*e* is held in contact with the associated set of strings 16, and prevents the associated set of strings from resonant vibrations. However, when the associated key 11*a*/11*b* is moved from the rest position to the end position, the rear end portion of the associated key 11*a*/11*b* causes the damper lever 17*b* to turn in the clockwise direction, and the damper lever 17*b* upwardly pushes the damper block 17*c*, the damper wire 17*d* and the damper head 17*e* so as to space the damper head 17*e* from the associated set of strings 16. As a result, the associated set of strings 16 becomes vibrative.

While the associated key 11*a*/11*b* is being moved from the rest position to the end position, the key action mechanism 13, the damper mechanism 17 and the hammer assembly 15 behave as follows.

The capstan button 13*c* pushes the whippen assembly 13*b* during the rotation of the associated key 11*a*/11*b*, and the whippen assembly 13*b* turns around the whippen flange 13*a* in the clockwise direction without a relative rotation between the whippen assembly 13*b* and the jack 13*d*. The jack 13*d* pushes the hammer roller 15*f*, and the hammer assembly 15 turns around the hammer shank flange 15*a* in the counter clockwise direction.

The rear end portion of the associated key 11*a*/11*b* is brought into contact with the damper lever 17*b*, and causes the damper lever 17*b* to turn around the damper lever flange 17*a* in the clockwise direction. The damper lever 17*b* pushes up the damper block 17*c*, the damper wire 17*d* and the damper head 17*e*, and the damper head 17*e* is spaced from the associated set of strings 16.

When the toe 13*o* is brought into contact with the regulating button 13*n*, the jack 13*d* turns around the whippen assembly 13*b* in the counter clockwise direction, and causes the hammer assembly 15 to escape therefrom. The hammer assembly 15 starts a free rotation, and strikes the associated set of strings 16. The damper head 17*e* has been already spaced from the set of strings 16, and the strings vibrate for generating a piano sound.

The hammer top felt 15*d* rebounds on the set of strings 16, and turns in the clockwise direction. The back check 15*e* receives the hammer wood 15*c*.

When the key 11*a*/11*b* is released, the capstan button 13*c* is downwardly moved, and the rear end position of the key 11*a*/11*b* allows the damper lever 17*b* to turn around the damper lever flange 17*a* in the counter clockwise direction. The whippen assembly 13*b* turns around the whippen flange 13*a* in the counter clockwise direction. The toe 13*o* is spaced from the regulating button 13*n*, and the leading end portion 13*j* is moved beneath the hammer roller 15*f*. Thus, the key action mechanism 13 and the hammer assembly 15 return to the initial positions shown in FIG. 5. The damper lever 17*b* downwardly moves the damper block 17*c*, the damper wire 17*d* and the damper head 17*e*, and the damper head 17*e* is brought into contact with the set of strings 16, again. As a result, the damper head 17*e* absorbs the vibrations of the strings 16, and extinguishes the piano sound.

Recording System

Turing back to FIG. 3 of the drawings, the recording system 20 includes a plurality of key sensors 21 respectively associated with the plurality of black and white keys 11*a* and 11*b*, a plurality of hammer sensors 22 respectively associated with the hammer assemblies 15 and a controlling unit 23. The controlling unit 23 is shared between the recording system 20 and the automatic playing system 30 as described hereinlater.

The key sensor 21 is implemented by a shutter plate 21*a* and photo-interrupters 21*b*, and monitors the associated key 11*a*/11*b*. The photo-interrupters 21*b* are arranged along the trajectory of the associated shutter plate 21*a*. The shutter plate 21*a* sequentially interrupts the optical beams of the photo-interrupters 21*b* during the movement from the rest position to the end position, and allows the photo-interrupters 21*b* to establish the optical beams during the movement from the end position to the rest position. The photo-interrupter changes the potential level of a key position signal between the photo-interruption and the photo-detection, and the controlling unit 23 periodically scans the photo-interrupters of the key sensors 21*b* to see whether or not any one of the black and white keys 11*a*/11*b* changes the status of the key sensors 21*b*. One of the photo-interrupters 21*b* gives a key-on timing for generating the piano sound to the controlling unit 23, and the controlling unit 23 calculates a key velocity from a time interval between the photo-interruptions.

The hammer sensors 22 are also implemented by shutter plates 22*a* respectively attached to the hammer shanks 15*b* and photo-interrupters, and the photo-interrupters 22*b* are arranged along the trajectories of the shutter plates 22*a*. The photo-interrupters 22*b* generate hammer position signals, and the controlling unit 23 periodically checks the photo-interrupters to see whether or not any one of the hammer position signals changes the potential level as similar to the key sensors 21.

The controlling unit 23 generates music data codes representative of the key/hammer motions during a performance, and the music data codes are stored in a suitable memory such as, for example, a floppy disk (not shown).

Automatic Playing System

The automatic playing system 30 includes a frame structure 30*a*, a plurality of solenoid-operated key actuator units 31 respectively associated with the black and white keys 11*a*/11*b*, a driver circuit mounted on a circuit board 30*c* for selectively energizing the solenoid-operated key actuators 31 and the controlling unit 23.

Figure 4:
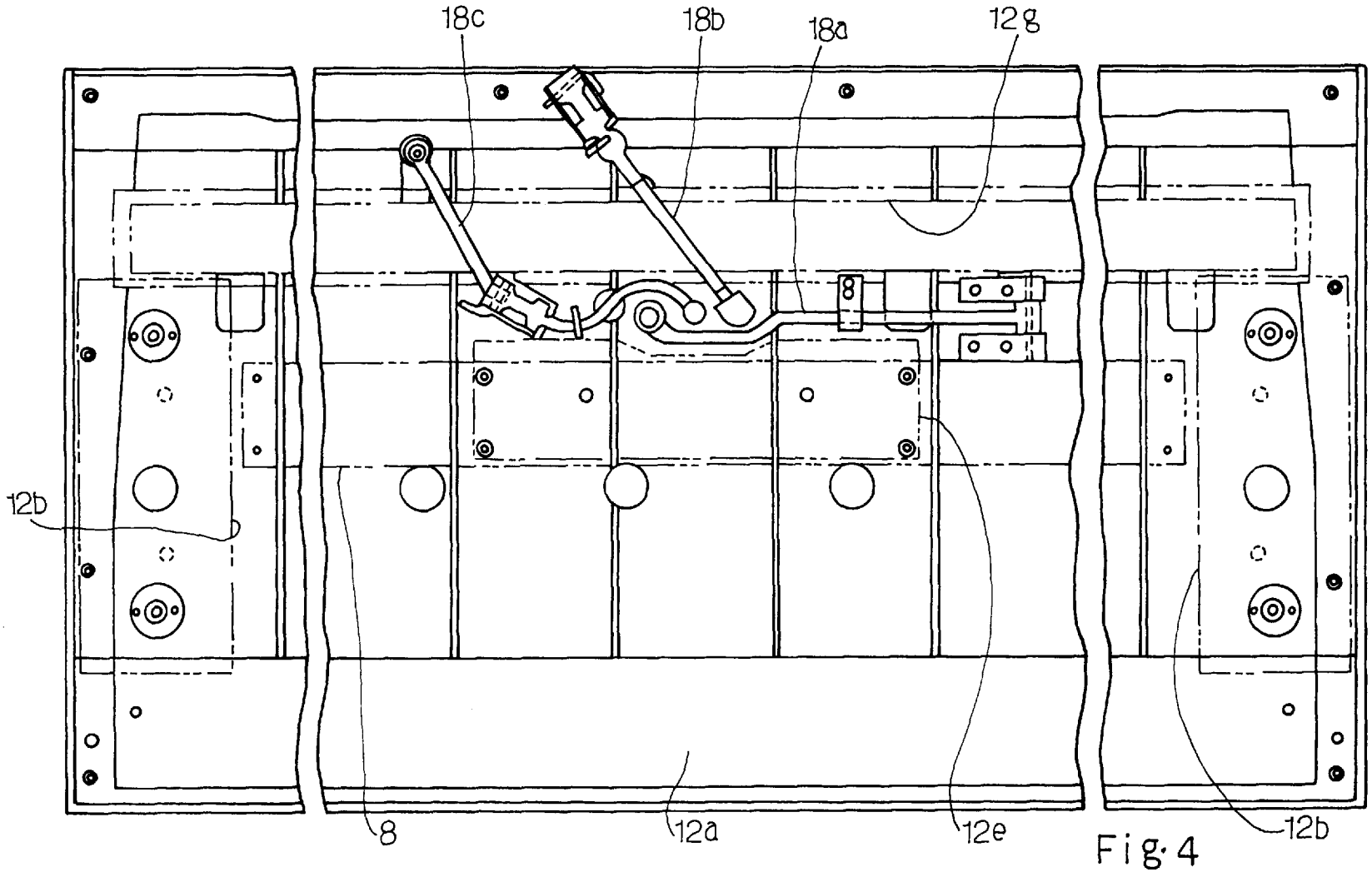
FIG. 4 is a bottom view showing the arrangement of pedal mechanisms on a key bed of the automatic player piano.

A slot 12*g* is formed in the key bed 12*a*, and is elongated in the lateral direction (see FIG. 4). The solenoid-operated key actuator units 31 and the circuit board 30*c* are mounted on the frame structure 30*a*, and are accommodated in the slot 12*g*.

Figure 6:
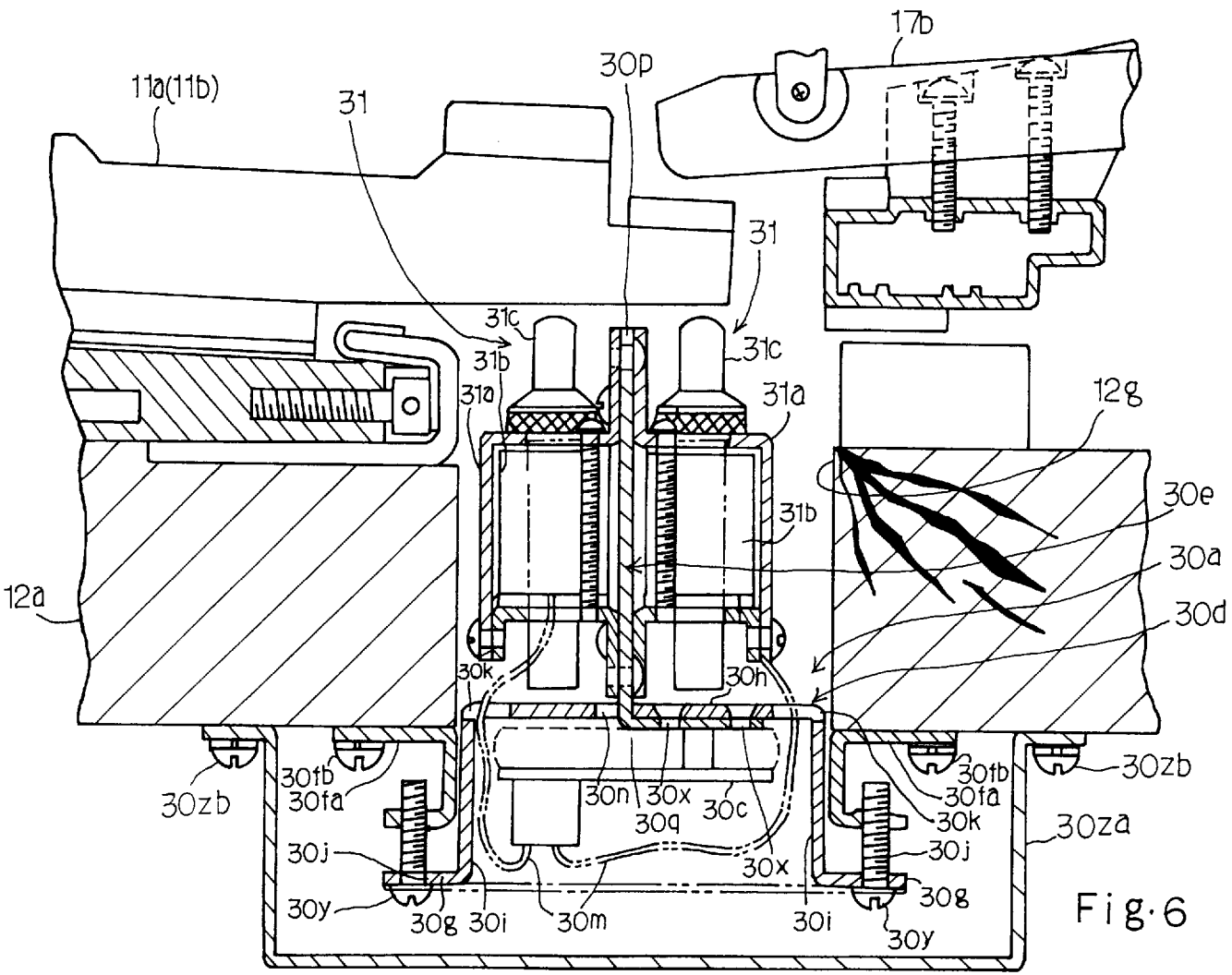
FIG. 6 is a cross sectional view showing solenoid-operated key actuator units mounted on a frame structure.

As will be seen in FIG. 6, the frame structure 30*a* includes a base plate 30*d* and a center plate 30*e*. The base plate 30*d* is fixed to bracket members 30*fa* by means of bolts 30*y*, and the bracket members 30*fa* in turn are bolted to the lower surface of the key bed 12*a* by means of the bolts 30*fb* as described hereinbefore. The bracket members 30*fa* are formed of metal, and the bolt holes of the bracket members 30*fa* are hardly broken. The center plate 30*e* is formed of magnetic material such as, for example, soft iron, and is assembled with the base plate 30*d* in such a manner as to be upright from the base plate 30*d*.

Figure 7:
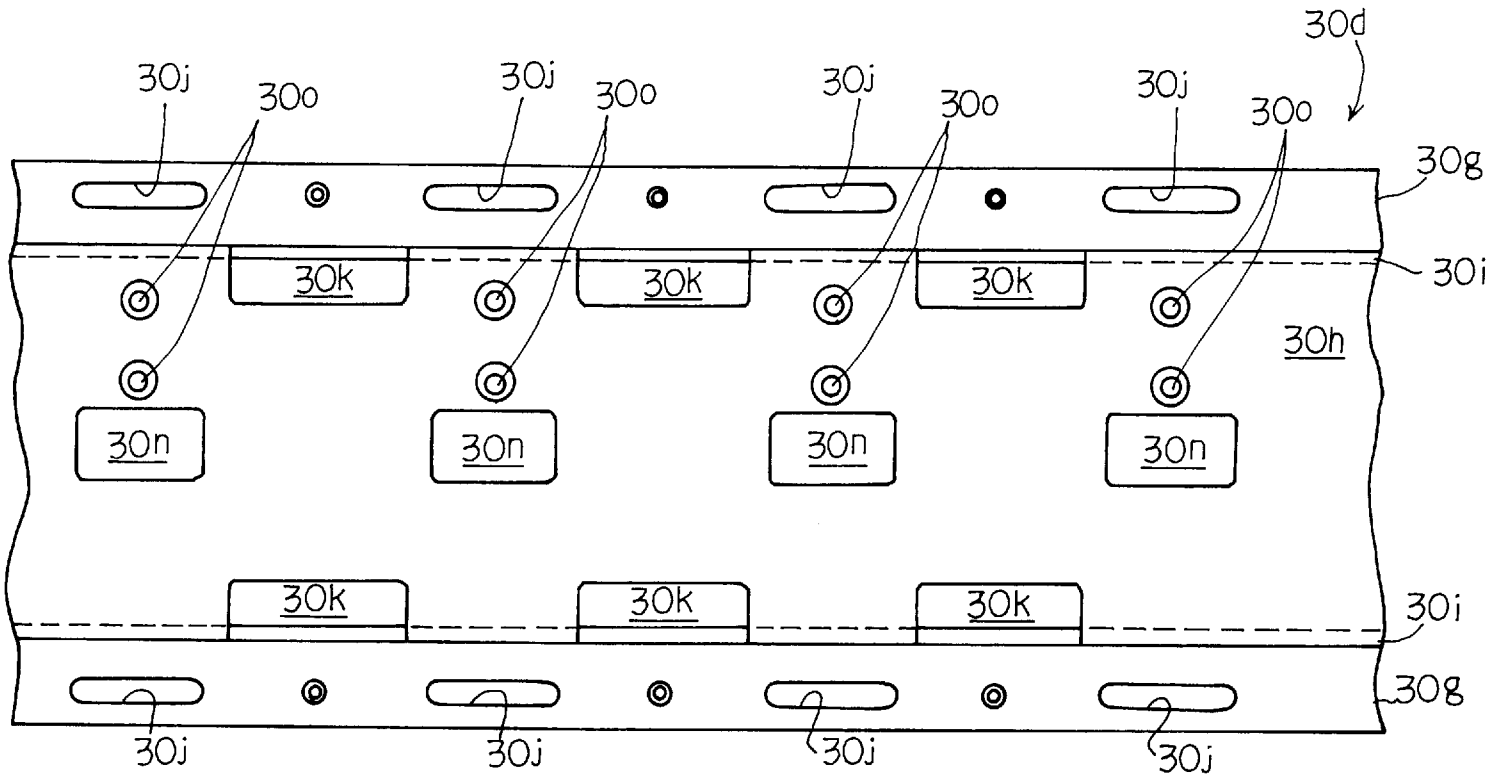
FIG. 7 is a plan view showing a base plate of the frame structure.

The base plate 30*d* is shaped into a channel, and is elongated as long as the slot 12*g*. As shown in FIG. 7, the base plate 30*d* has wing portions 30*g*, a flat portion 30*h* and side wall portions 30*i* between the flat portion 30*h* and the wing portions 30*g*, and elongated bolt holes 30*j* are formed in the wing portions 30*g* at a constant pitch. Two lines of rectangular through-holes 30*k* are formed in the flat portion 30*h* along the side wall portions at the constant pitch, and wirings 30*m* pass through the rectangular through-holes (see FIG. 6). A line of other rectangular through-holes 30*n* is further formed in the flat portion at the constant pitch between the two lines of rectangular through-holes 30*k*, and the rectangular through-holes 30*n* are deviated from the rectangular through-holes 30*k* by a half of the constant pitch. The center plate 30*e* passes through the rectangular through-holes 30*n*, and is assembled with the base plate 30*d*. Pairs of through-holes 30*o* are further formed in the flat portion 30*h* between the line of rectangular through-holes 30*n* and one of the side wall portions 30*i*, and countersinks are formed for the through-holes 30*o*.

Figure 8A:
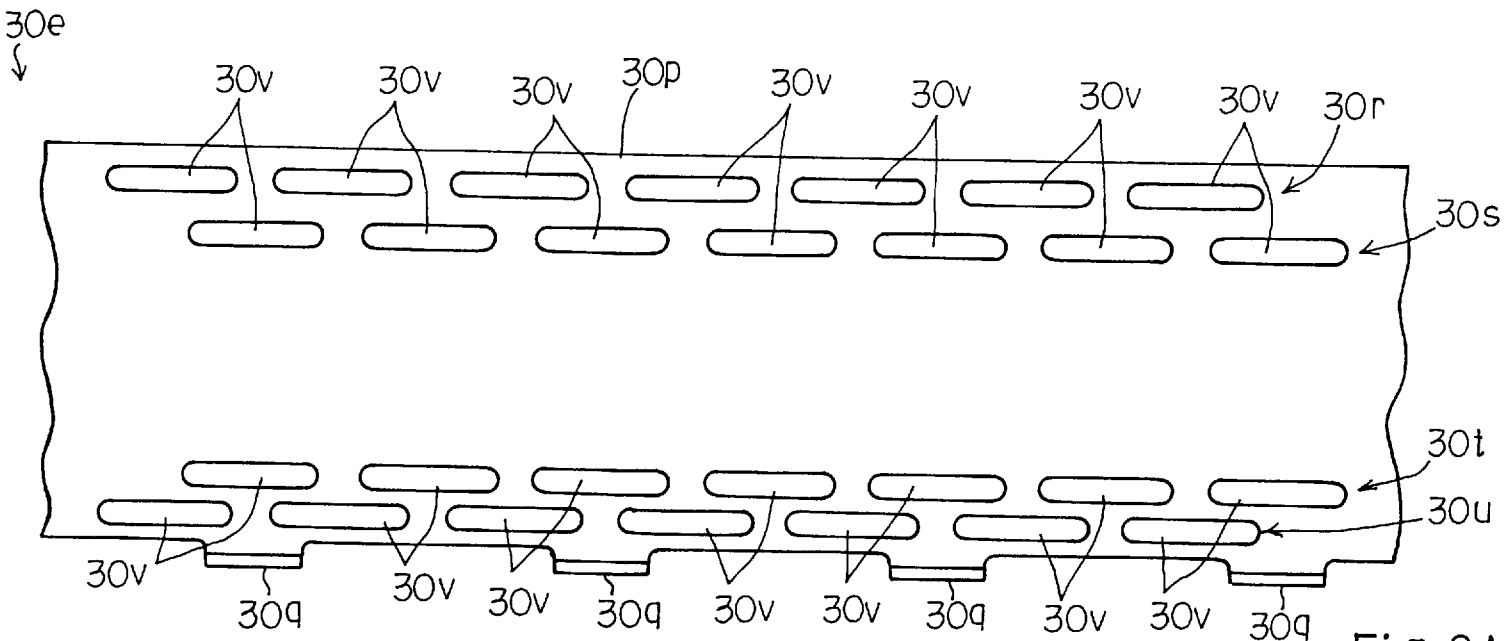
FIG. 8A is a front view showing a center plate of the frame structure.
Figure 8B:
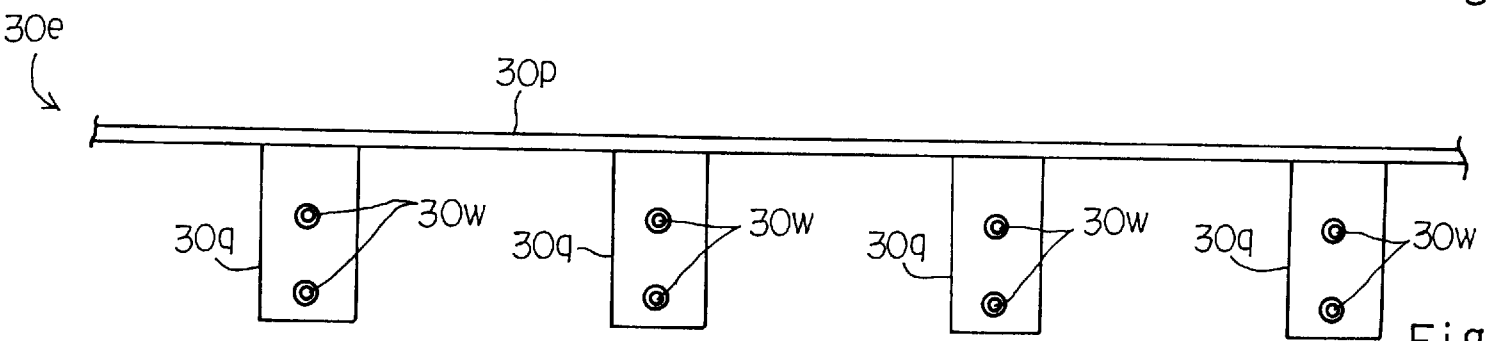
FIG. 8B is a plan view showing the center plate.

On the other hand, the center plate 30*e* has a vertical plate portion 30*p* and a plurality of projecting portions 30*q* projecting from the lower end of the vertical plate portion 30*p* at the constant pitch as shown in FIGS. 8A and 8B. Four lines 30*r*/30*s*/30*t*/30*u* of elongated holes 30*v* are formed in the vertical plate portion 30*p*. The two lines 30*r*/30*s* of elongated holes 30*v* and the other lines of elongated holes 30*v* are close to the upper end and the lower end of the vertical plate portion 30*p*. The elongated holes 30*v* of the lines 30*r* and 30*u* are respectively deviated from the elongated holes 30*v* of the lines 30*s* and 30*t*, and elongated holes 30*v* of the lines 30*r* and 30*s* are respectively aligned with the elongated holes 30*v* of the lines 30*u* and 30*t*. The pitch of the elongated holes 30*v* in each line 30*r*/30*s*/30*t*/30*u* is approximately equal to the pitch of the keys 11*a*/11*b*. Pairs of threaded holes 30*w* are formed in the projecting portions 30*q*, respectively.

The base plate 30*d* is assembled with the center plate 30*e* as follows. First, an assembling worker obliquely inserts the projecting portions 30*q* into the rectangular through-holes 30*n*, and turns the vertical plate portion 30*p* so as to bring the projecting portions 30*q* into contact with the flat portion 30*h*. Then, the vertical plate portion 30*p* is upright from the flat portion 30*h* of the base plate 30*d*, and the pairs of threaded holes 30*w* are respectively aligned with the pairs of through-holes 30*o*. Bolts 30*x* are screwed through the through-holes 30*o* into the threaded holes 30*w*, and the bolts press the projecting portions 30*g* against the flat portion 30*h*. Thus, the projecting portions 30*q* are fixed to the flat portion 30*h*, and the center plate 30*e* is assembled with the base plate 30*d*. The solenoid-operated key actuator units 31 are supported by the vertical plate portion 30*p* as will be described hereinlater.

After the assemblage of the base plate 30*d* and the center plate 30*e*, bolts 30*y* are screwed through the elongated holes 30*j* into threaded holes formed in the bracket members 30*fa*. The elongated holes 30*j* allow the assembling worker to regulate the relative position between the base plate 30*d* and the bracket members 30*fa* in the lateral direction, and the solenoid-operated key actuator units 31 are respectively placed beneath the associated black and white keys 11*a*/11*b*. The vertical plate portion 30*p* extends in the slot 12*g* in the lateral direction, and is substantially positioned on the center line of the slot 12*g*. The solenoid-operated key actuator units 31 are alternately provided on both sides of the vertical plate portion 30*p*, and, accordingly, staggered along the center line of the slot 12*g*.

Moreover, the assembling worker regulates the gap between the wing portions 30*g* and the bracket members 30*fa* and, accordingly, the gap between the solenoid-operated key actuator units 31 and the lower surfaces of the associated keys 11*a*/11*b* by rotating the bolts 30*y*. The flat portion 30*h* is as wide as the slot 12*g*, and the base plate 30*d* is moved into and out of the slot 12*g* during the regulating work. In detail, when the assembling worker rotates the bolts 30*y* in one direction, the distance between the wing portions 30*g* and the bracket members 30*fa* is decreased, and, accordingly, the base plate 30*d* lifts the solenoid-operated key actuators 31. On the other hand, if the bolts 30*y* are rotated in the other direction, the distance between the wing portions 30*g* and the bracket members 30*fa* is increased, and the base plate 30*d* spaces the solenoid-operated actuator units 31 from the associated keys 30*b*.

The frame structure 30*a* further includes guard members 30*za* screwed to the key bed 12*a* at intervals by means of bolts 30*zb*. As described hereinbelow, the base plate 30*d* is fixed to the bracket members 30*fa* by means of the bolts 30*y*. However, if the bolts 30*y* are undesirably loosened, the base plate 30*d*, the center plate 30*e* and the solenoid-operated key actuator units 31 are dropped from the key bed 12*a*. However, the guard members 30*za* receive the base plate 30*d*, and prevent the solenoid-operated key actuator units 31 from destruction.

Figure 9B:
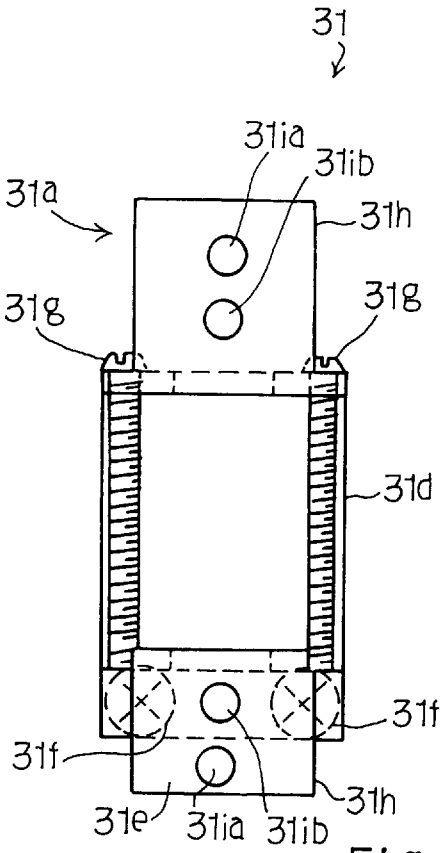
FIG. 9B is a front view showing the solenoid-operated key actuator unit.
Figure 9A:
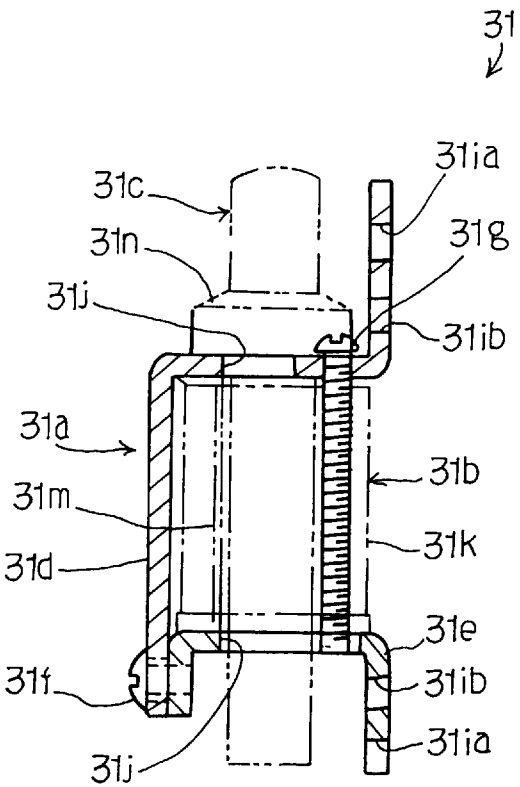
FIG. 9A is a side view showing a solenoid-operated key actuator unit incorporated in the automatic player piano.

The solenoid-operated key actuate or unit 31 is illustrated in detail in FIGS. 9A and 9B. The solenoid-operated key actuator unit 31 includes a yoke 31*a*, a solenoid 31*b* and a plunger 31*c*. The yoke 31*a* is formed of magnetic material, and a magnetic path is formed in the yoke 31*a*. The solenoid 31*b* is combined with the yoke 31*a*, and the plunger 31*c* is inserted into the solenoid 31*b*.

The yoke 31*a* is formed from two members 31*d* and 31*e*. The first member 31*d* is bent like a crank, and the second member 31*e* is shaped into a channel. The first member 31*d* is combined with the second member 31*e* by means of bolts 31*f* and 31*g* in such a manner that fin portions 31*h* project. Holes 31*ia* and 31*ib* are formed in the fin portions 31*h*, and through-holes 31*j* are formed in the first and second members 31*d*/31*e* in such a manner as to be aligned with each other.

A coil member 31*k* is wound on a cylindrical bobbin 31*m*, and the coil member 31*k* and the cylindrical bobbin 31*m* form in combination the solenoid 31*b*. The solenoid 31*b* is inserted into the recess formed in the yoke 31*a*, and the through-hole of the cylindrical bobbin 31*m* are aligned with the through-holes 31*j*. The cylindrical bobbin 31*m* is snugly received between the first member 31*d* and the second member 31*e*, and the bolts 31*g* do not allow the solenoid 31*b* to fall from the yoke 31*a*.

The plunger 31*c* is inserted into the through-holes 31*j* and the through-hole of the cylindrical bobbin 31*m*, and is slidable along the through-holes of the cylindrical bobbin 31*m*. The plunger 31*c* is formed of magnetic material, and a stopper 31*n* is attached to the upper end portion of the plunger 31*c*. The stopper 31*n* does not allow the plunger 31*c* to fall down from the cylindrical bobbin 31*m*.

Figure 10:
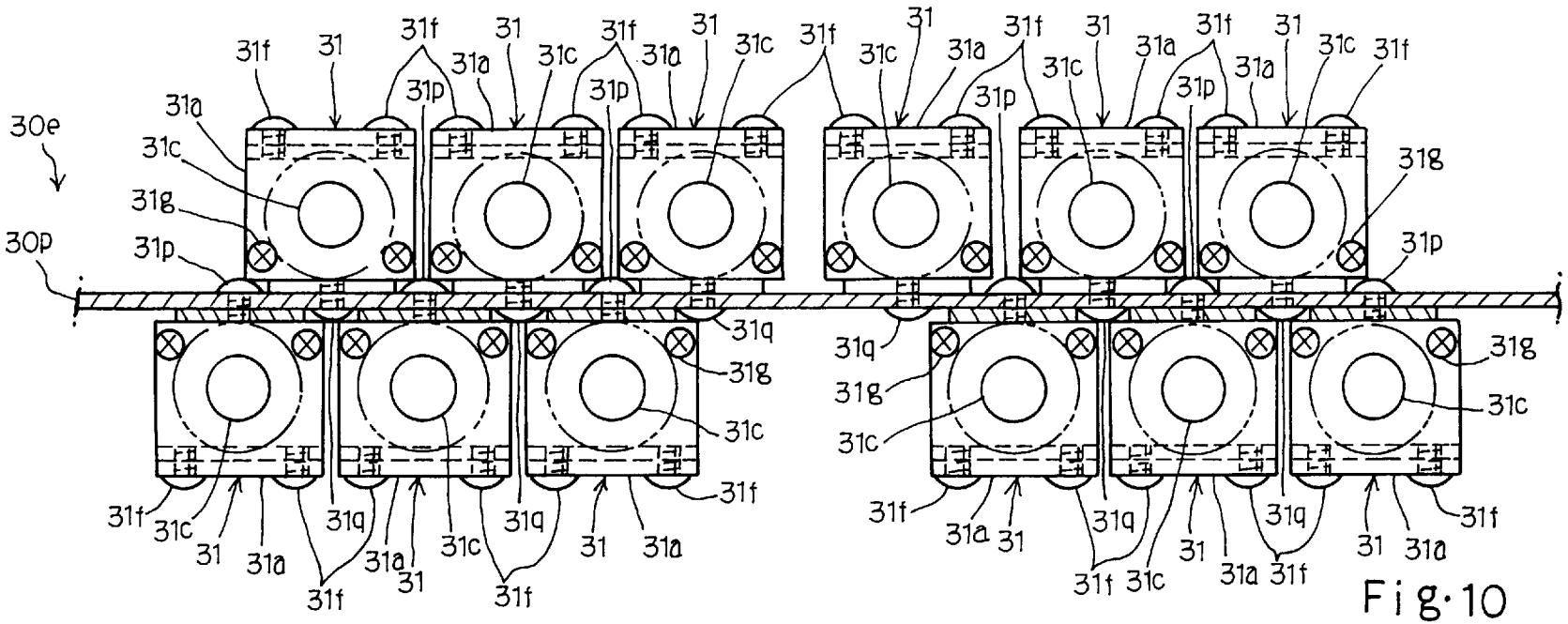
FIG. 10 is a plan view showing the layout of the solenoid-operated key actuator units.
Figure 11A:
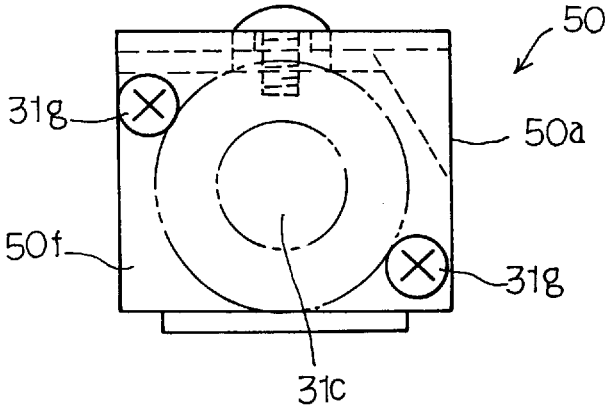
FIG. 11A is a plan view showing a modification of the solenoid-operated key actuator unit.
Figure 11B:
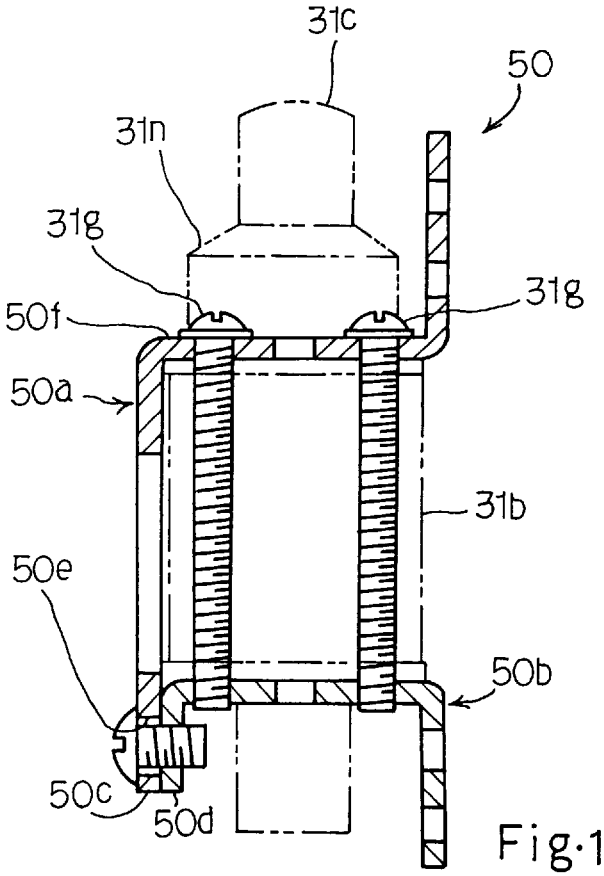
FIG. 11B is a side view showing the modification.
Figure 11C:
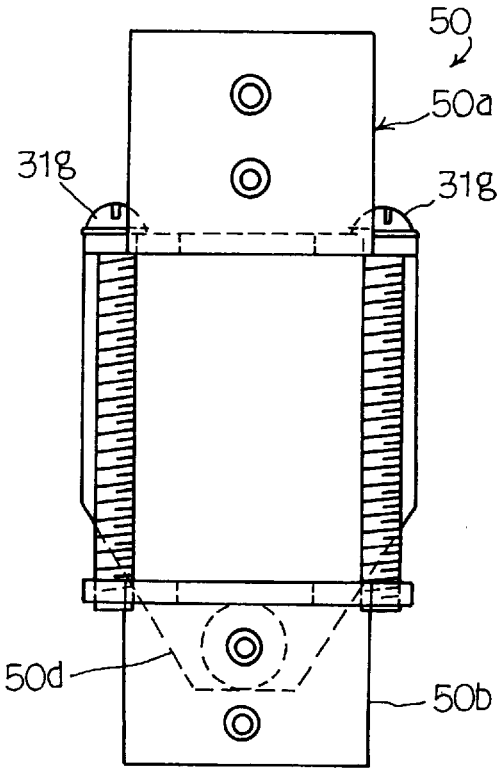
FIG. 11C is a rear view showing the modification.
Figure 11D:
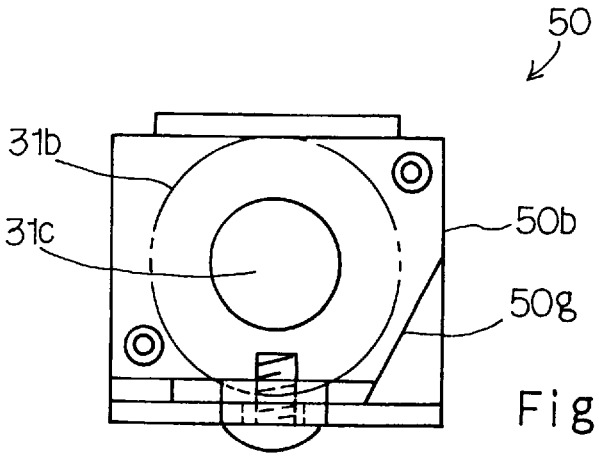
FIG. 11D is a bottom view showing the modification.

The yokes 31*a* are bolted to the vertical plate portion 30*p* of the center plate 30*e*, and the solenoid-operated key actuator units 31 are alternately attached to both vertical surfaces of the vertical plate portion 30*p*. As a result, the solenoid-operated key actuator units 31 are arranged in a staggered manner in the lateral direction as shown in FIG. 10. The staggered arrangement allows the manufacturer to enlarge the solenoids 31*b*, and the solenoid-operated key actuator unit 31 exerts large force on the associated key 11*a*/11*b*. Moreover, the two rows of solenoid-operated key actuator units 31 are spaced in the fore-and-aft direction, and the plungers 31*c* are leveled. This results in improvement in durability.

As described hereinbefore, the elongated holes 30*v* are formed in the vertical plate portion 30*p*, and the elongated holes 30*v* of the outer lines 30*r*/30*u* and the elongated holes 30*v* of the inner lines 30*s*/30*t* are aligned with the outer through-holes 31*ia* and the inner through-holes 31*ib*, respectively. In order to attach the solenoid-operated key actuators 31*f* on one side of the vertical plate portion 30*p* are fixed to the center plate 30*e*, the outer through-holes 31*ia* are aligned with the elongated holes 30*v* of the outer lines 30*r*/30*u*, and regulates the solenoid-operated key actuators 31 to appropriate positions for the associated keys 11*a*/11*b*. Bolts 31*p* are screwed into the outer through-holes 31*ia* and the elongated holes 30*v* of the outer lines 30*r*/30*u*, and the solenoid-operated key actuator units 31 are fixed to the vertical surface of the vertical plate portion 30*p*. On the other hand, when the other solenoid-operated key actuator units 31 are fixed to the other vertical surface of the vertical plate portion 30*p*, the inner through-holes 31*ib* are aligned with the elongated holes 30*v* of the inner lines 30*s*/30*t*, and the solenoid-operated key actuator units 31 are regulated to appropriate positions for the associated keys 11*a*/11*b*. Bolts 31*q* are screwed into the inner through-holes 31*ib* and the elongated holes 30*v* of the inner lines 30*s*/30*t*. Thus, the solenoid-operated key actuator units 31 are arranged in the staggered manner on both vertical surfaces of the center plate 30*e*, and the elongated holes 30*v* allow an assembling worker to exactly align the plungers 31*c* with the keys 11*a*/11*b*. The vertical plate portion 30*p* is formed of the magnetic material, and allows the magnetic paths to pass therethrough.

The solenoids 31*b* are connected through the wirings 30*m* to the driver circuit mounted on the circuit board 30*c* accommodated in the space under the solenoid-operated key actuators 31 (see FIG. 6). For this reason, the wirings 30*m* are short, and the wiring arrangement is simple. The driver circuit is powered by an electric power source mounted on another rigid circuit board (not shown), and a controlling circuit is also provided on the rigid circuit board. The controlling circuit forms a part of the controlling unit 23, and instructs the driving circuit to selectively energize the solenoid 31*b*. The controlling circuit may be fabricated on the circuit board 30*c* together with the driving circuit.

In this instance, the bracket members 30*fa* serve as the bracket member, and the base plate 30*d* and the center plate 30*e* as a whole constitute the supporting structure.

Description is hereinbelow made on a repairing work on the assumption that one of the solenoid-operated key actuators is damaged at user's home. Firstly, the repairing worker loosens the bolts 30*zb*, and takes away the guard members 30*za*. The guard members 30*zb* are light, and the removal is easy.

After the driving circuit is disconnected from the controlling circuit, the repairing worker loosens the bolts 30*y* , and separates the base plate 30*d* from the bracket members 30*fa*. The base plate 30*d* and, accordingly, the solenoid-operated key actuator units 31 attached to the center plate 30*e* slowly fall out from the slot 12*g* of the key bed 12*a*. The keyboard 11 is never removed from the key bed 12*a*.

Subsequently, the repairing worker loosens the bolts 31*p* or 31*q*, and separates the yoke 31*a* of the damaged solenoid-operated key actuator unit from the center plate 30*e*. The stopper 31*n* is taken away, and the plunger 31*c* is removed. The repairing worker loosens the bolts 31*g*, and changes the damaged solenoid 31*b* to new one.

The plunger 31*c* is inserted into the new solenoid 31*b*, and the stopper 31*n* is attached to the plunger 31*c*, again. The repairing worker bolts the solenoid-operated key actuator unit 31 to the center plate 31*e*, and regulates the new solenoid-operated key actuator unit 31 to the appropriate position for the associated key 11*a*/11*b*.

The repairing worker lifts the base plate 30*d*, and screws the bolts 30*y* through the holes of the base plate 30*d* into the holes of the bracket members 30*fa*. The gap between the keys 11*a*/11*b* and the plungers 31*c* is regulated to 0.5 millimeter to 1 millimeter by using the bolts 30*y*.

The bracket members 30*fa* and the keyboard 11 have been never removed from the key bed 12*a*, and the relative position between the bracket members 30*fa* and the keyboard 11 is never changed. For this reason, when the base plate 30*d* is bolted to the bracket members 30*fa*, the plungers 31*c* are exactly aligned with the rear end portions of the associated keys 1*a*/11*b*, respectively. Finally, the guard members 30*za* are bolted to the key bed 12*a*, again.

As will be appreciated from the foregoing description, the bracket members 30*fa* are never taken away from the wooden key bed 12*a*, and the bolts 30*fb* are strongly engaged with the wooden key bed 12*a*. For this reason, the base plate 30*d* does not undesirably fall down due to insufficient engagement between the bolts 30*fb* and the wooden key bed 12*a*.

Moreover, the bracket members 30*fa* create a space under the solenoid-operated key actuator units 31, and the circuit board 30*c* is accommodated in the space. This results in the simple wiring arrangement, and makes the automatic playing system 30 compact.

The solenoid 31*b* is enlarged by virtue of the staggered arrangement of the solenoid-operated key actuator units 31, and the plungers 31*c* are hardly deformed.

The frame structure 30*a* and the solenoid-operated key actuator units 31 are accommodated in the slot 12*g*, and the automatic playing system 30 does not interfere with the pedal mechanisms 18*a* to 18*c*. Therefore, a standard acoustic piano is retrofitted to the automatic player piano.

The magnetic path is formed through the center plate 30*e* and the yoke 31*a*. In other words, the center plate 30*e* serves as part of the yoke 31*a*, and decreases the total weight of the frame structure 30*a* and the solenoid-operated key actuator units 31.

The automatic player piano behaves as follows. When a player instructs the recording system 20 to record a performance on the keyboard 11, the key sensors 21 and the hammer sensors 22 cooperate with one another, and the controlling unit 23 determine the motions of depressed keys 11*a*/11*b* and the associated hammer assemblies 15. The key/hammer motions are described in music data codes, and are stored in a suitable non-volatile memory such as a floppy disk.

When the player instructs the automatic playing system 30 to playback the performance, the controlling unit 23 reads out the music data codes, and instructs the driving circuit to selectively energize the solenoids 31*b* of the solenoid-operated key actuator units 31.

If the controlling unit 23 instructs the driving circuit to energize the solenoid-operated key actuator unit associated with the key 11*a* shown in FIG. 6, the driving circuit supplies the current through the wiring 30*m* to the coil member 31*k*, and the coil member 31*k* generates magnetic field. The yoke 31*a* and the vertical plate member 30*p* serve as the magnetic path, and the electromagnetic force is exerted on the plunger 31*c*. Then, the plunger 31*c* upwardly projects from the solenoid 31*b*, and pushes up the rear end portion of the associated key 11*a*.

The key 11*a* turns as if a player depresses it, and actuates the key action mechanism 13. The key action mechanism 13 allows the hammer assembly 15 to escape therefrom, and the hammer assembly 15 strikes the set of strings 16 for generating the piano sound.

After the strike with the hammer assembly, the driving circuit stops the current, and the plunger 31*c* is retracted into the solenoid 31*b*.

Although a particular embodiment of the present invention has been shown and described, it will be obvious to those skilled in the art that various changes and modifications may be made without departing from the spirit and scope of the present invention.

FIGS. 11A to 11D illustrate a modification of the solenoid-operated key actuator unit. The modification is only different in the structure of yoke 50 from the solenoid-operated key actuator unit 31. For this reason, description is focused on the structure of the yoke 50, and other components are labeled with the same references used for the solenoid-operated key actuator unit 31. The yoke 50 also includes a first member 50*a* and the second member 50*b*. The lower end portion 50*c* of the first member 50*a* and the corresponding portion 50*d* of the second member 50*b* are tapered as will be seen in FIG. 11C. The tapered portions 50*c* and 50*d* decrease the total weight of the yoke 50, and allow a tool to reach the bolts 31*p*/31*q*. Through-hole 50*e* is formed in the lower end portion 50*c*, and a bolt 50 is screwed through the through-hole 50*e* into the corresponding portion

50*d*. The first member 50*a* and the second member 50*b* are combined with each other by means of the bolts 31*g* on the diagonal line on the upper portion 50*f* of the first member 50*a*. The bolts 31*g* sandwich the solenoid 31*b* between the first and second members 50*a*/50*b* without loss of balance. The fin portion 50*g* of the second member 50*b* is partially cut away, and a repairing worker makes the tool easily reach the bolts 31*p*/31*q*.

The four lines of elongated holes 30*v* may be replaced with two pairs of rails attached to the vertical plate portion 30*p*, and the solenoid-operated key actuator units 31 are regulated to the appropriate positions by using the rails.

The yokes 31*a* may be slidably supported in the up-and-down direction by the center plate 31*e*, and bolts individually move the yokes so as to regulate the gaps between the plungers and the associated keys.

The acoustic piano may be an upright piano, and hammer stoppers may be provided for preventing the strings from the hammers.

What is claimed is:

1. An automatic player piano comprising an acoustic piano including a keyboard having a plurality of turnable keys arranged in a lateral direction for generating acoustic piano sounds and provided over an upper surface of a wooden key bed formed with a slot under said plurality of turnable keys; and an automatic playing system including a bracket member formed of metal and fixed to a lower surface of said wooden key bed, a supporting structure including a center plate partially inserted into said slot and having a plurality of bolt holes arranged at intervals in said lateral direction and elongated in said lateral direction, means for regulating a distance between said wooden key bed and said supporting structure, said regulating means including movably mounted bolts screwed through said supporting structure to said bracket member, and a plurality of solenoid-operated key actuator units connected to said center plate by means of bolts passing through said plurality of bolt holes in a staggered manner on a virtual plane substantially in parallel to said lower surface of said wooden key bed so that said plurality of solenoid-operated key actuator units are laterally regulable and having respective plungers respectively aligned with said plurality of keys so as to push said plurality of keys when said plurality of solenoid-operated key actuator units are energized.

2. The automatic player piano as set forth in claim 1, in which said supporting structure has a base plate having an upper surface substantially in parallel to said lower surface of said wooden key bed and bolted to said bracket member, and a center plate upright from said upper surface of said base plate and elongated along said slot, and said plurality of solenoid-operated key actuator units are divided into two groups one of which is attached to one surface of said center plate and the other of which is attached to the other surface of said center plate.

3. The automatic player piano as set forth in claim 2, in which each of said plurality of solenoid-operated key actuator units includes a yoke member formed of a magnetic material and having through-holes and an opening, a cylindrical solenoid inserted through said opening into an inner space of said yoke member, and a plunger inserted through said through-holes into said cylindrical solenoid, and said center plate is formed of a magnetic material, and said yoke member is attached to said center plate in such a manner as to close said opening.

4. The automatic player piano as set forth in claim 3, in which a plurality of elongated holes are formed in said center plate, and bolts are fixed through said yoke member into the elongated holes so that the plunger of each of said plurality of solenoid-operated key actuator units is aligned with one of said plurality of turnable keys.

5. The automatic player piano as set forth in claim 2, in which said base plate has a lower surface where a circuit board for a driving circuit is attached.

6. The automatic player piano as set forth in claim 4, further comprising a guard member attached to said lower surface of said wooden key bed and defining a space together with said key bed for accommodating said bracket member and said supporting structure therein.

* * * * *